US007909534B1

(12) United States Patent
Comer et al.

(10) Patent No.: US 7,909,534 B1
(45) Date of Patent: Mar. 22, 2011

(54) APPARATUS AND METHOD FOR ENDGATE WITH ANGLE ADJUSTMENT

(75) Inventors: Kevin Comer, Puyallup, WA (US); Jeff Cartwright, Puyallup, WA (US)

(73) Assignee: Astec Industries, Inc., Chattanooga, TN (US)

( * ) Notice: Subject to any disclaimer, the term of this patent is extended or adjusted under 35 U.S.C. 154(b) by 505 days.

(21) Appl. No.: 11/888,110

(22) Filed: Jul. 31, 2007

(51) Int. Cl.
*E01C 19/22* (2006.01)

(52) U.S. Cl. ..... 404/118; 404/83; 404/84.05; 404/84.1; 404/84.2; 404/84.5

(58) Field of Classification Search ..... 404/83–118
See application file for complete search history.

(56) References Cited

U.S. PATENT DOCUMENTS 3,680,451 A * 8/1972 Birtchet ..... 404/104
3,877,830 A * 4/1975 James, III ..... 404/84.1
3,957,384 A * 5/1976 Lamb et al. ..... 404/118
3,989,402 A * 11/1976 James, III ..... 404/110
3,997,277 A * 12/1976 Swisher et al. ..... 404/84.05
4,818,140 A * 4/1989 Carlson ..... 404/118
5,096,331 A * 3/1992 Raymond ..... 404/118
5,201,603 A * 4/1993 Bassett et al. ..... 404/84.1
5,868,522 A 2/1999 Campbell
6,238,134 B1 * 5/2001 Sovik ..... 404/72
6,238,136 B1 * 5/2001 Sovik et al. ..... 404/87
6,318,928 B1 11/2001 Swearingen
7,108,450 B2 * 9/2006 Grubba ..... 404/84.5
7,316,520 B2 * 1/2008 Grubba ..... 404/84.05

* cited by examiner

*Primary Examiner* — Raymond W Addie
(74) *Attorney, Agent, or Firm* — Chambliss, Bahner & Stophel, P.C.

(57) ABSTRACT

An endgate comprising a mounting bracket adapted to be attached to a screed assembly, a pivoting plate adapted to be pivotally attached to the mounting bracket, a sliding plate, a pavement contacting surface and a support adapted to be pivotally moved with the pivoting plate, a means for applying force to the pavement contacting surface disposed between the support and the sliding plate, a first adjustment means adapted to adjust the amount of force applied by the means for applying force to the pavement contacting surface and a second adjustment means adapted to adjust the angle of the pavement contacting surface. A method comprising providing such an endgate, adjusting the angle of the pavement contacting surface and adjusting the amount of force applied by the means for applying force to the pavement contacting surface.

20 Claims, 7 Drawing Sheets

APPARATUS AND METHOD FOR ENDGATE WITH ANGLE ADJUSTMENT

FIELD OF THE INVENTION

The present invention relates generally to screed assemblies adapted to apply hot mix asphalt to surfaces, and particularly to screed assemblies having endgates.

BACKGROUND AND DESCRIPTION OF THE PRIOR ART

It is known to use endgates in connection with screed assemblies adapted to apply hot mix asphalt to surfaces such as roadways, parking lots and the like. However, conventional endgates suffer from one or more disadvantages. For example, conventional endgates include a plurality of independent adjustment means and a plurality of independent means for applying force to the wear shoe. As a result, adjustment of conventional endgates is difficult and time-consuming, and each of the plurality of independent means for applying force to the wear shoe may experience unequal loads. In addition, the means for applying force to the wear shoe in conventional endgates do not remain perpendicular to the wear shoe of the endgate when the wear shoe is disposed at an angle. Consequently, conventional endgates do not maintain optimal surface contact with the hot mix asphalt applied by the screed assembly and they do not maintain uniform pressure on the hot mix asphalt.

It would be desirable, therefore, if an apparatus and method for an endgate with angle adjustment could be provided that would result in easier, less time-consuming adjustments. It would also be desirable if such an apparatus and method could be provided such that each of the means for applying force to the wear shoe would apply an equal load to the wear shoe. It would be further desirable if such an apparatus and method could be provided that would maintain each of the means for applying force to the wear shoe substantially perpendicular to the wear shoe when the wear shoe is disposed at an angle. It would be still further desirable if such an apparatus and method could be provided that would maintain optimal surface contact with the hot mix asphalt applied by the screed assembly and maintain uniform pressure on the hot mix asphalt.

ADVANTAGES OF THE PREFERRED EMBODIMENTS OF THE INVENTION

Accordingly, it is an advantage of the preferred embodiments of the invention claimed herein to provide an apparatus and method for an endgate with angle adjustment that results in easier, less time-consuming adjustments. It is also an advantage of the preferred embodiments of the invention to provide an endgate with angle adjustment in which each of the means for applying force to the wear shoe or other pavement contacting surface applies an equal load to the wear shoe or other pavement contacting surface. It is a further advantage of the preferred embodiments of the invention to provide an endgate with angle adjustment that maintains each of the means for applying force to the pavement contacting surface substantially perpendicular to the pavement contacting surface of the endgate when the pavement contacting surface is disposed at an angle. It is a still further advantage of the preferred embodiments of the invention to provide an endgate with angle adjustment that maintains optimal surface contact with the hot mix asphalt applied by the screed assembly and maintains uniform pressure on the hot mix asphalt.

Additional advantages of the preferred embodiments of the invention will become apparent from an examination of the drawings and the ensuing description.

SUMMARY OF THE INVENTION

The invention comprises an endgate adapted to be attached to a screed assembly. The preferred endgate comprises a mounting bracket that is adapted to be attached to the screed assembly, a pivoting plate that is adapted to be pivotally attached to the mounting bracket, and a sliding plate that is adapted to be pivotally moved with the pivoting plate. The preferred endgate also includes a pavement contacting surface that is adapted to be pivotally moved with the pivoting plate, a support that is adapted to be pivotally moved with the pivoting plate, and a means for applying force to the pavement contacting surface that is disposed between the support and the sliding plate. The preferred endgate further includes a first adjustment means that is adapted to adjust the amount of force applied by the means for applying force to the pavement contacting surface and a second adjustment means that is adapted to adjust the angle of the pavement contacting surface.

In the preferred embodiments of the endgate, the sliding plate includes a flange, the pavement contacting surface is a wear shoe, the means for applying force to the pavement contacting surface comprises a plurality of springs that are biased between the support and the flange, and the first adjustment means and the second adjustment means are jacks. Also in the preferred embodiments of the endgate, the pivoting plate, the support, the means for applying force to the pavement contacting surface and the pavement contacting surface remain in a substantially fixed disposition relative to each other when the pavement contacting surface is pivotally moved. In another preferred embodiment, each of the plurality of springs is maintained in a substantially perpendicular disposition relative to the pavement contacting surface when the pavement contacting surface is pivotally moved. Further, in a preferred embodiment of the endgate, each of the plurality of springs applies a substantially equal amount of force to the pavement contacting surface.

The invention also comprises a method for an endgate with angle adjustment that is adapted to be attached to a screed assembly. The preferred method comprises providing an endgate including a mounting bracket that is adapted to be attached to the screed assembly, a pivoting plate that is adapted to be pivotally attached to the mounting bracket, and a sliding plate that is adapted to be pivotally moved with the pivoting plate. The preferred endgate also includes a pavement contacting surface that is adapted to be pivotally moved with the pivoting plate, a support that is adapted to be pivotally moved with the pivoting plate, and a means for applying force to the pavement contacting surface that is disposed between the support and the sliding plate. The preferred endgate further includes a first adjustment means that is adapted to adjust the amount of force applied by the means for applying force to the pavement contacting surface and a second adjustment means that is adapted to adjust the angle of the pavement contacting surface. The method further comprises adjusting the angle of the pavement contacting surface and adjusting the amount of force applied to the means for applying force to the pavement contacting surface.

In the preferred embodiments of the method, the pivoting plate, the support, the means for applying force to the pavement contacting surface and the pavement contacting surface remain in a substantially fixed disposition relative to each other when the pavement contacting surface is pivotally moved. Also in the preferred embodiments of the method, the means for applying force to the pavement contacting surface is maintained in a substantially perpendicular disposition relative to the pavement contacting surface when the pavement contacting surface is pivotally moved, and the sliding plate is adapted to be slidingly moved relative to the pivoting plate in a direction substantially perpendicular to the pavement contacting surface.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
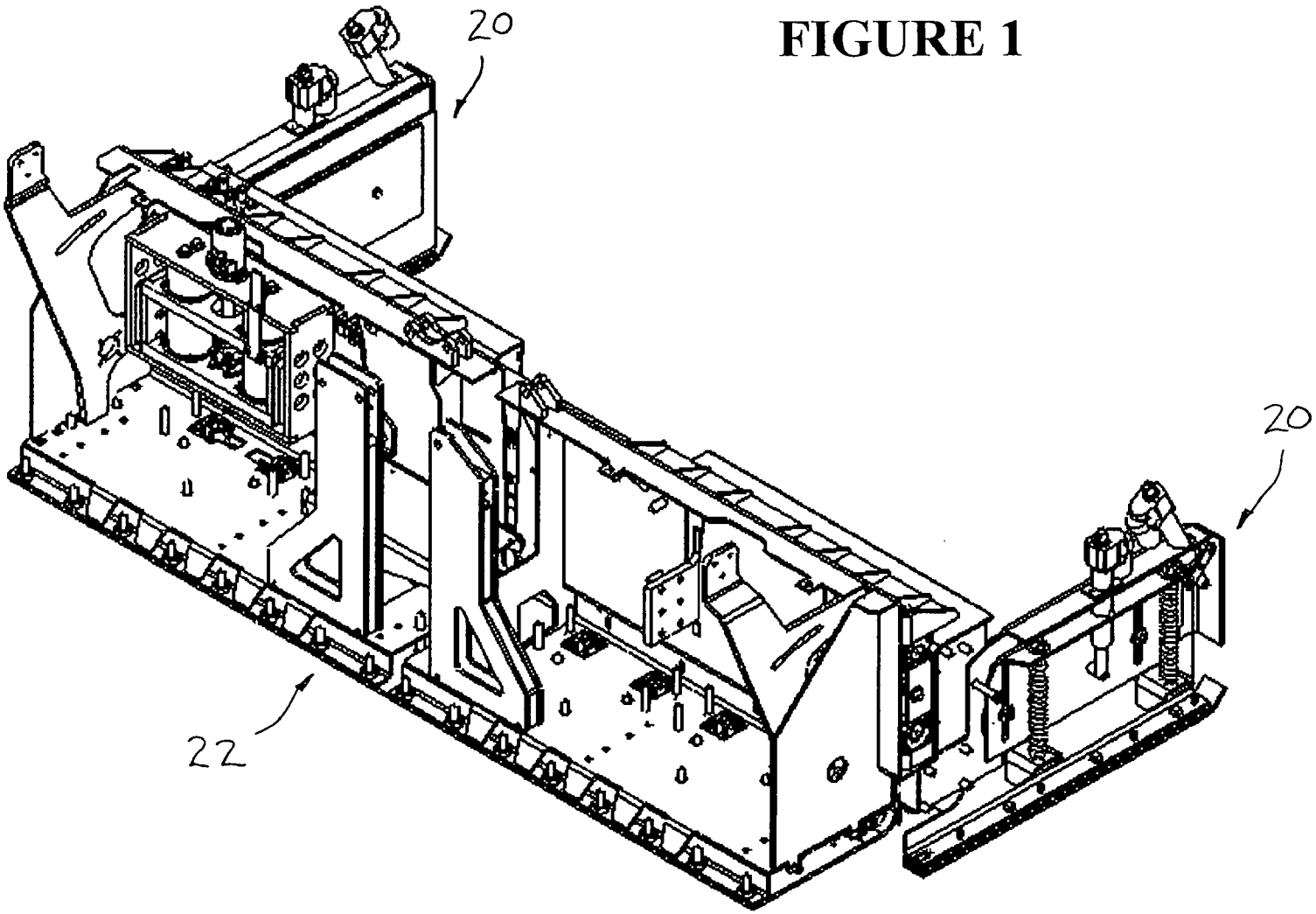
FIG. 1 is a perspective view of an exemplary screed including the preferred endgates with angle adjustment in accordance with the present invention.

Referring now to the drawings, the preferred embodiment of the endgate with angle adjustment is illustrated by FIGS. 1 through 7. Referring to FIG. 1, a perspective view of an exemplary screed including the preferred endgate in accordance with the present invention is illustrated. As shown in FIG. 1, the preferred endgate is designated generally by reference numeral 20. The preferred endgate 20 is adapted to be attached to exemplary screed 22 which is part of a screed assembly. More particularly, preferred endgate 20 is adapted to be attached to the outer, distal ends of a main screed or a screed extension to prevent the outward movement of hot mix asphalt applied by a screed assembly beyond the width of the main screed or any screed extensions. The preferred endgate 20 is also adapted to provide a finished edge to the hot mix asphalt applied by a screed assembly. It is contemplated within the scope of the invention that the preferred endgate 20 may be removably or fixedly connected to a screed assembly by any suitable means.

Figure 2:
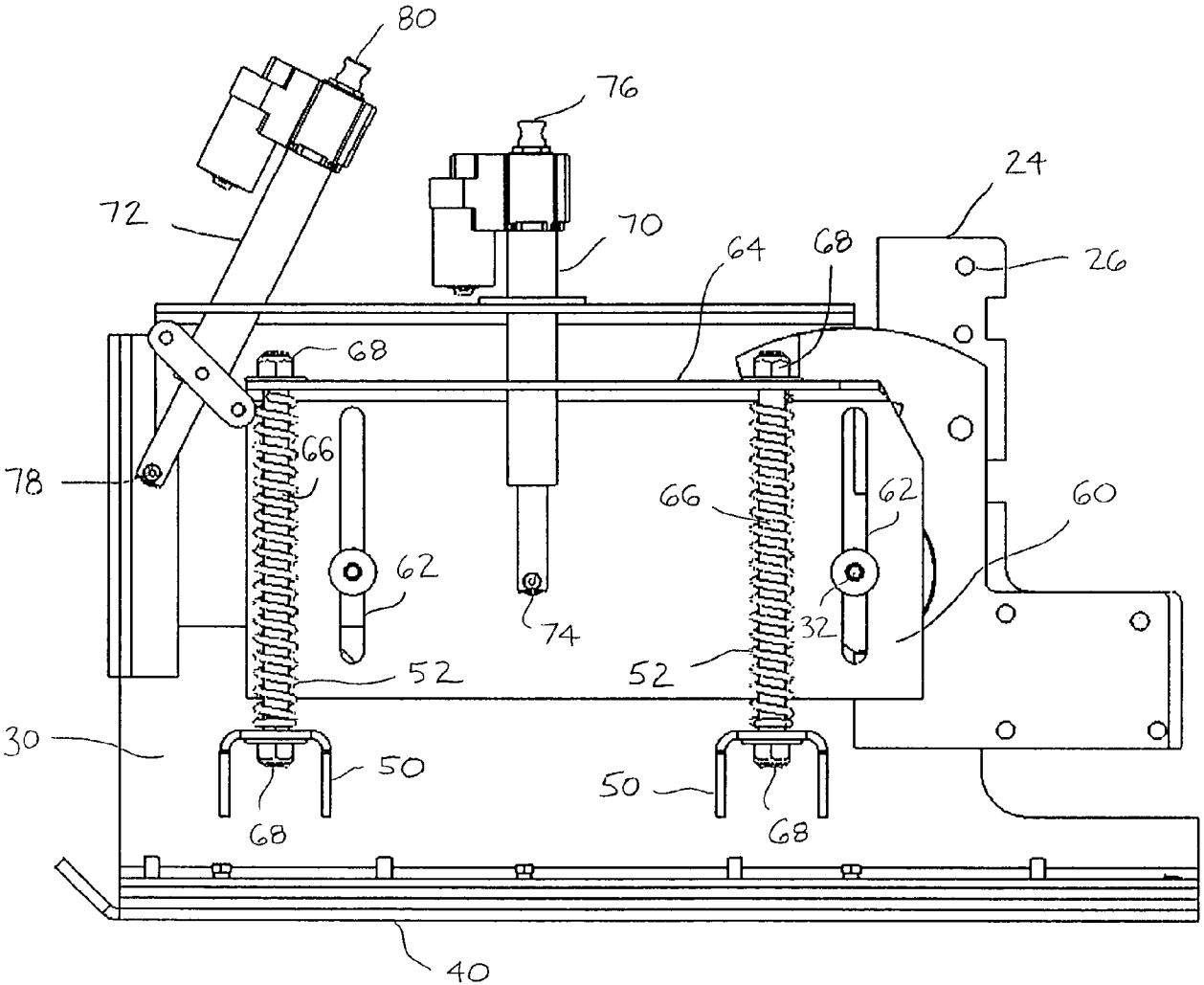
FIG. 2 is a front view of the preferred endgate with angle adjustment illustrated in FIG. 1.

Referring now to FIG. 2, a front view of preferred endgate 20 is illustrated. As shown in FIG. 2, the preferred endgate 20 is attached to a screed such as exemplary screed 22 by mounting bracket 24. The preferred mounting bracket 24 includes a plurality of holes 26 adapted to receive fasteners such as bolts or rivets, but it is contemplated within the scope of the invention that the mounting bracket may include slots or other suitable means for attaching the endgate to a screed assembly. It is also contemplated within the scope of the invention that the mounting bracket may be attached to a screed assembly by weldment, adhesives and the like. Further, while FIG. 2 illustrates the preferred configuration of the mounting bracket, it is contemplated within the scope of the invention that the mounting bracket may be any suitable configuration adapted to attach the endgate to a screed assembly.

Referring still to FIG. 2, the preferred endgate 20 includes pivoting plate 30. The preferred pivoting plate 30 is pivotally attached to mounting bracket 24 at pivot point 32. While FIG. 2 illustrates the preferred configuration and arrangement of pivoting plate 30, it is contemplated within the scope of the invention that the pivoting plate may be of any suitable configuration and arrangement adapted to pivotally move relative to the mounting bracket. As shown in FIG. 2, a pavement contacting surface such as preferred wear shoe 40 is disposed near the bottom of the preferred pivoting plate 30. The preferred wear shoe 40 is adapted to be pivotally moved with pivoting plate 30. In addition, the preferred wear shoe 40 is adapted to contact the paving surface. While FIG. 2 illustrates the preferred configuration and arrangement of the pavement contacting surface, it is contemplated within the scope of the invention that the pavement contacting surface may be of any suitable configuration and arrangement. It is further contemplated within the scope of the invention that the pavement contacting surface may be an integral component of the endgate or a contiguous part of the pivoting plate. It is still further contemplated within the scope of the invention that the pavement contacting surface may be heated and/or vibrated using any suitable means.

Referring still to FIG. 2, the preferred endgate 20 includes a support such as the preferred pair of spring supports 50. Each of the preferred pair of spring supports 50 is mounted on pivoting plate 30. Further, each of the preferred spring supports 50 is adapted to be pivotally moved with the pivoting plate and provide support to one of the means for applying force to the pavement contacting surface such as the preferred plurality of springs 52. While FIG. 2 illustrates a pair of spring supports, it is contemplated within the scope of the invention that more or fewer than two supports may be provided. It is also contemplated within the scope of the invention that the support(s) may be of any suitable configuration and arrangement adapted to pivotally move with the pivoting plate and provide support for the means for applying force to the pavement contacting surface. Each of the preferred plurality of springs 52 is adapted to apply a substantially equal amount of force to wear shoe 40. It is contemplated within the scope of the invention, however, that any suitable device, mechanism, assembly or combination thereof may be used to apply force to the pavement contacting surface such as hydraulic actuators, pneumatic actuators, electric actuators, torsion springs, leaf springs and the like.

Still referring to FIG. 2, the preferred endgate 20 includes a sliding plate such as the preferred spring plate 60. The preferred spring plate 60 is adapted to be pivotally moved with pivoting plate 30 and slidingly moved relative to the pivoting plate. As shown in FIG. 2, the preferred spring plate 60 includes a pair of slots 62 adapted to permit the spring plate to slidingly move relative to pivoting plate 30. The preferred spring place 60 is adapted to move in a direction substantially perpendicular to the pavement contacting surface such as the preferred wear shoe 40. It is contemplated within the scope of the invention, however, that the spring plate may include more or fewer than two slots or any other suitable means for permitting the spring plate to slidingly move relative to the pivoting plate. The preferred spring plate 60 also includes flange 64. The preferred flange 64 is disposed near the top of spring plate 60 and is adapted to contact an end of each of the plurality of springs 52. As a result, each of the preferred plurality of springs 52 is biased between one of the preferred pair of spring supports 50 and the preferred flange 64 of spring plate 60. In addition, the preferred flange 64 is adapted to move relative to pivoting plate 30 in a direction substantially perpendicular to the pavement contacting surface such as the preferred wear shoe 40. It is contemplated within the scope of the invention, however, that any suitable structure, device, mechanism, assembly or combination thereof may be used to bear against an end of the means for applying force to the pavement contacting surface. As shown in FIG. 2, the preferred springs 52 are disposed around rods 66. The preferred rods 66 extend from the preferred pair of spring supports 50 to the preferred flange 64 and include a fastener such as nuts 68 on each end. It is further contemplated within the scope of the invention that any suitable device, mechanism, assembly or combination thereof may be used to maintain the disposition of the means for applying force to the pavement contacting surface.

Still referring to FIG. 2, the preferred endgate 20 includes a first adjustment means such as the preferred first jack 70 and a second adjustment means such as the preferred second jack 72. The preferred first jack 70 is adapted to adjust the amount of force applied to the means for applying force to the pavement contacting surface such as the preferred plurality of springs 52. As shown in FIG. 2, the preferred first jack 70 includes first jack first end 74 which is mounted to spring plate 60 and first jack second end 76 which is mounted to pivoting plate 30. The preferred second jack 72 is adapted to adjust the angle of the pavement contacting surface such as preferred wear shoe 40. The preferred second jack 72 includes second jack first end 78 which is mounted to mounting bracket 24 and second jack second end 80 which is mounted to pivoting plate 30. While FIG. 2 illustrates the preferred configuration and arrangement of the first jack and the second jack, it is contemplated within the scope of the invention that the first jack and the second jack may by of any suitable configuration and arrangement. It is also contemplated within the scope of the invention that any suitable device, mechanism, assembly or combination thereof adapted to adjust the amount of force applied to the means for applying force to the pavement contacting surface and/or adjust the angle of the pivoting plate and/or pavement contacting surface may be used such as electric actuators, hydraulic actuators, pneumatic actuators, hand cranks and the like.

Figure 3:
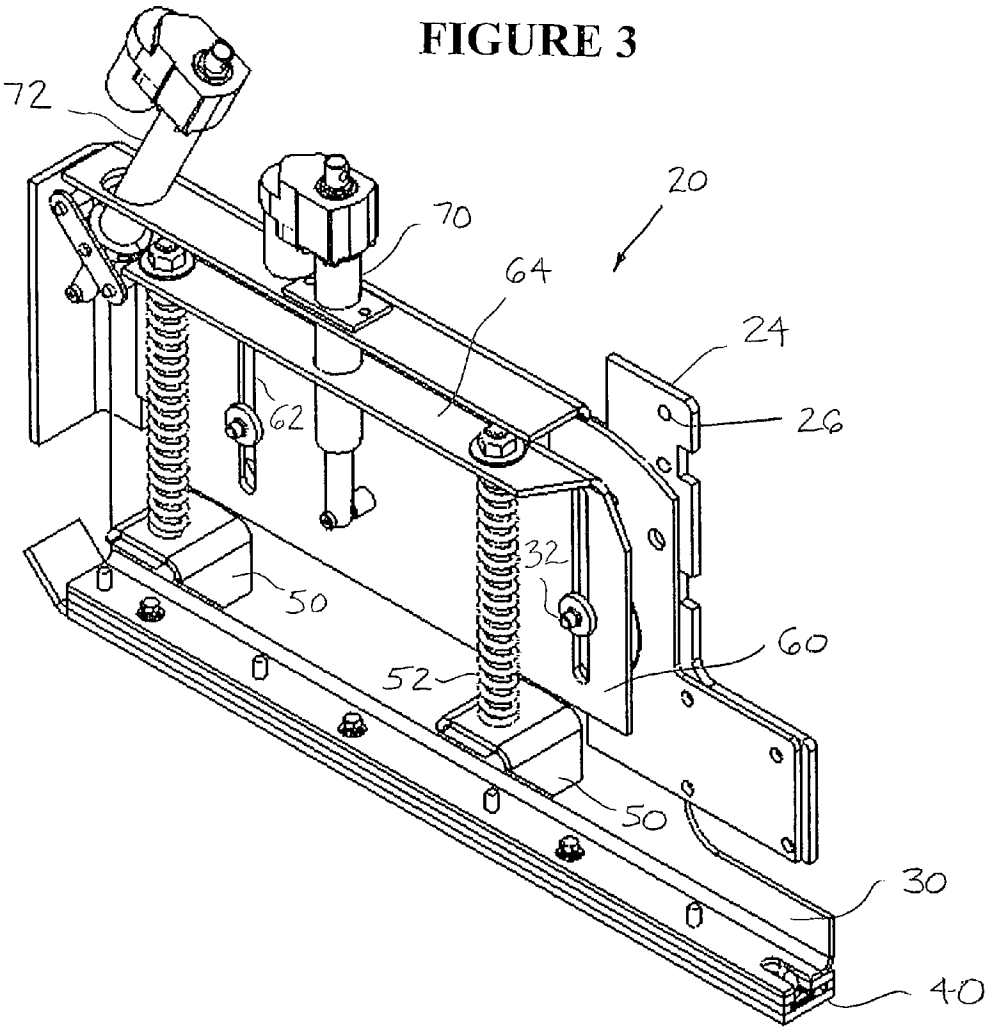
FIG. 3 is a perspective view of the preferred endgate with angle adjustment illustrated in FIGS. 1-2.

Referring now to FIG. 3, a perspective view of preferred endgate 20 is illustrated. As shown in FIG. 3, the preferred endgate 20 includes mounting bracket 24, holes 26, pivoting plate 30, wear shoe 40, spring supports 50, springs 52, spring plate 60, slots 62, flange 64, nuts 68, first jack 70 and second jack 72.

Figure 4:
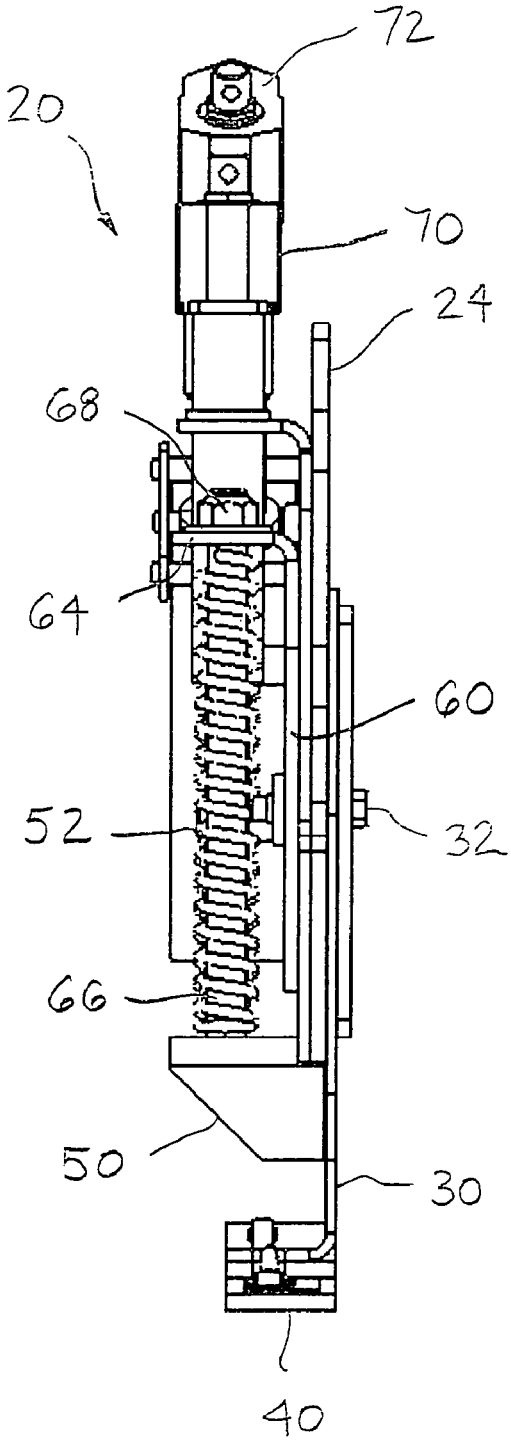
FIG. 4 is a right side view of the preferred endgate with angle adjustment illustrated in FIGS. 1-3.

Referring now to FIG. 4, a right side view of preferred endgate 20 is illustrated. As shown in FIG. 4, the preferred endgate 20 includes mounting bracket 24, pivoting plate 30, wear shoe 40, spring support 50, spring 52, spring plate 60, flange 64, rod 66, nut 68, first jack 70 and second jack 72.

Figure 5:
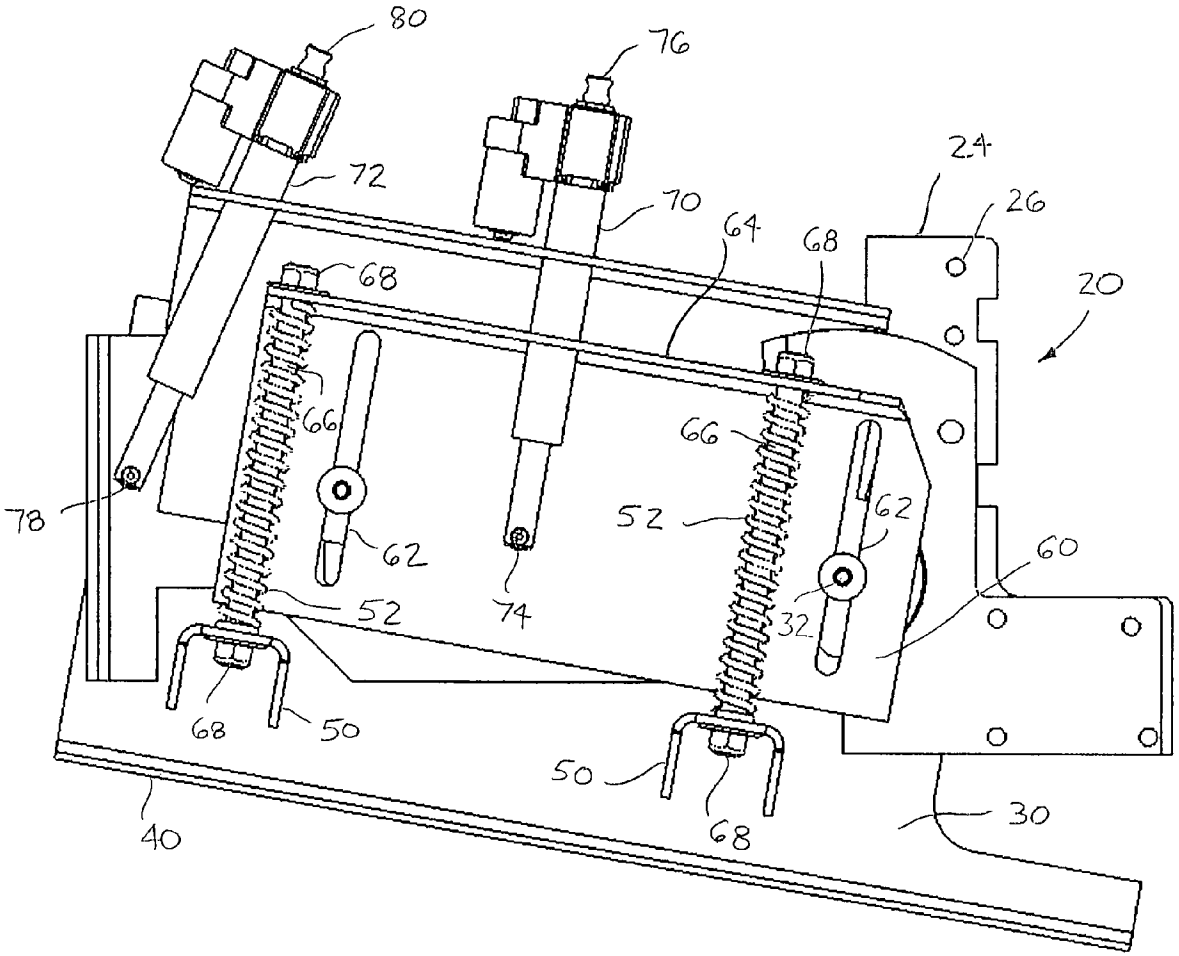
FIG. 5 is a front view of the preferred endgate with angle adjustment illustrated in FIGS. 1-4 showing the wear shoe disposed at an angle relative to the mounting bracket.

Referring now to FIG. 5, a front view of the preferred endgate 20 is illustrated. More particularly, the preferred endgate 20 is illustrated with the wear shoe disposed at an angle relative to the mounting bracket. As shown in FIG. 5, each of the pair of preferred springs 52 is maintained in a substantially perpendicular disposition relative to wear shoe 40 when pivoting plate 30, and thus wear shoe 40, is pivotally moved. As a result, each of the pair of preferred springs 52 applies a substantially equal amount of force. Preferably, pivoting plate 30, spring supports 50, springs 52 and wear shoe 40 remain in a substantially fixed disposition relative to each other when pivoting plate 30, and thus wear shoe 40, is pivotally moved.

Figure 6:
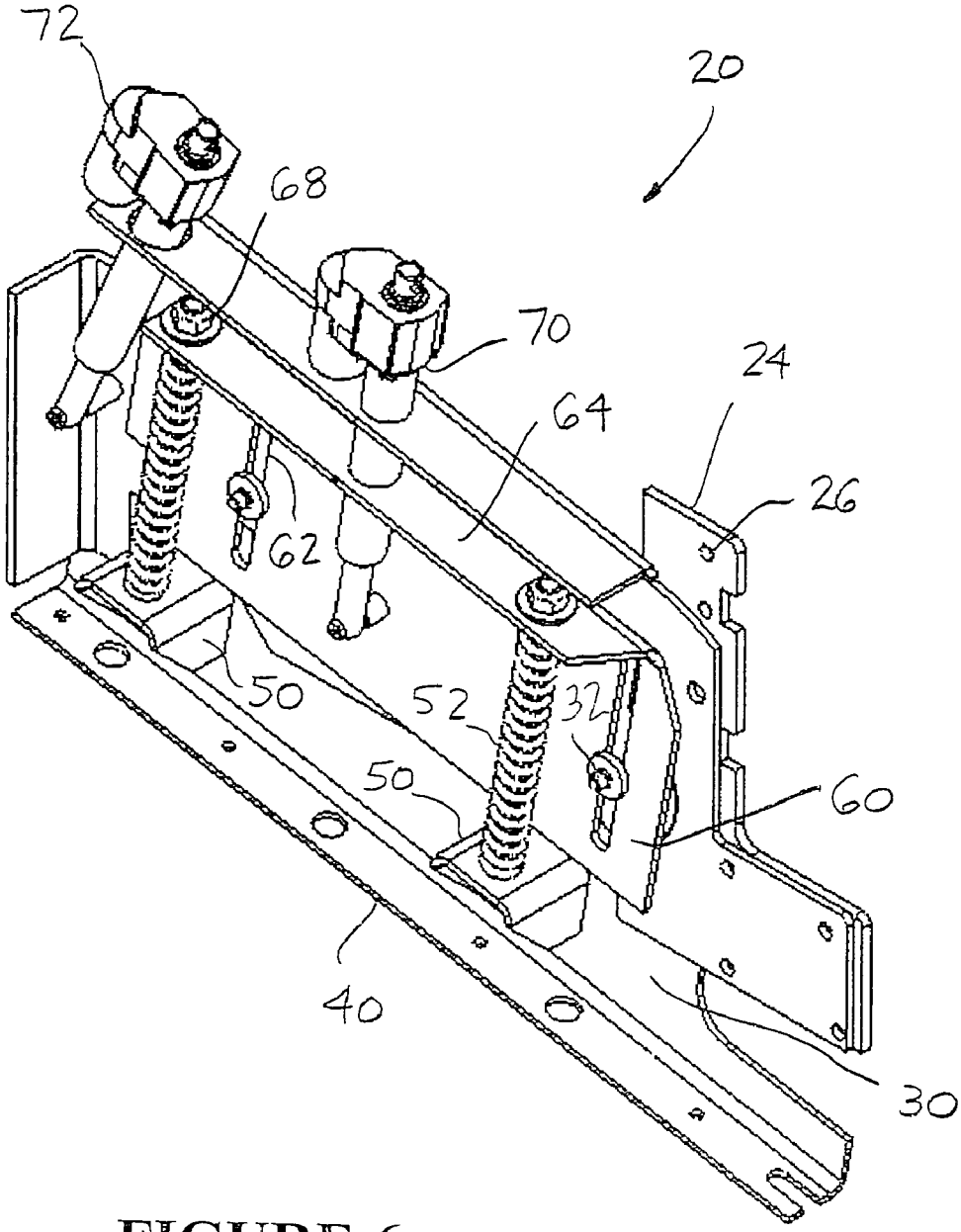
FIG. 6 is a perspective view of the preferred endgate with angle adjustment illustrated in FIGS. 1-5 showing the wear shoe disposed at angle relative to the mounting bracket.

Referring now to FIG. 6, a perspective view of the preferred endgate 20 is illustrated. More particularly, preferred endgate 20 is illustrated with the wear shoe disposed at angle relative to the mounting bracket. As shown in FIG. 6, the preferred endgate 20 includes mounting bracket 24, holes 26, pivoting plate 30, wear shoe 40, spring supports 50, springs 52, spring plate 60, slots 62, flange 64, nuts 68, first jack 70 and second jack 72.

Figure 7:
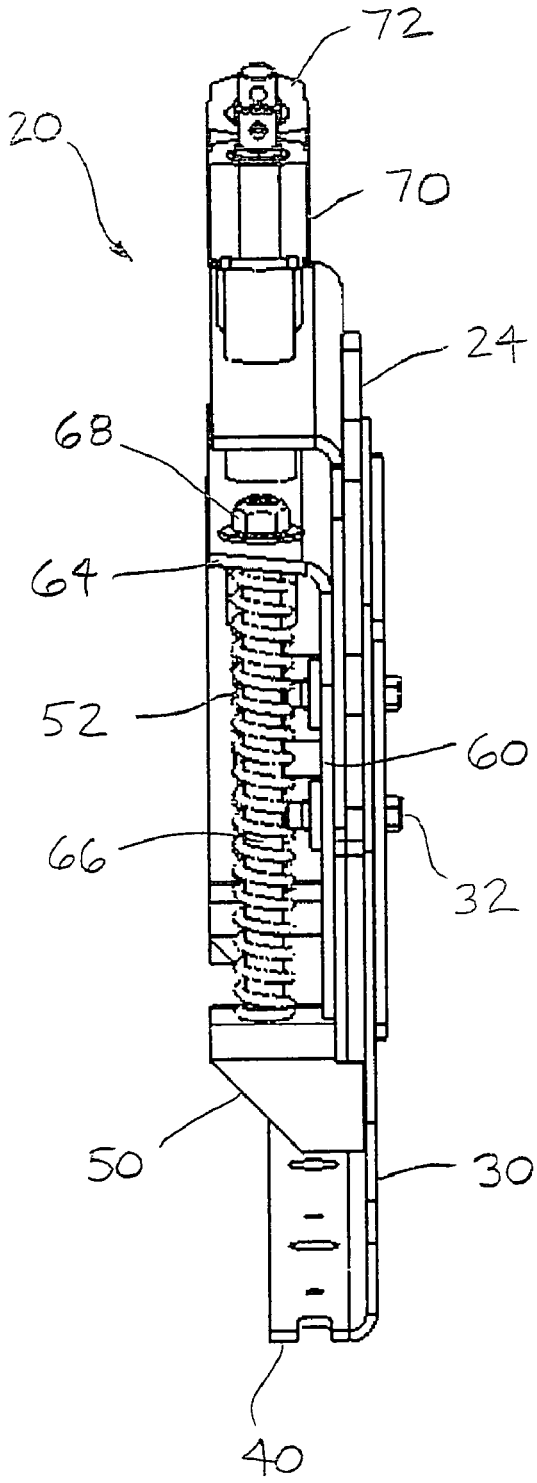
FIG. 7 is a right side view of the preferred endgate with angle adjustment illustrated in FIGS. 1-6 showing the wear shoe disposed at an angle relative to the mounting bracket.

Referring now to FIG. 7, a right side view of the preferred endgate 20 is illustrated. More particularly, preferred endgate 20 is illustrated with the wear shoe disposed at an angle relative to the mounting bracket. The preferred endgate 20 includes mounting bracket 24, pivoting plate 30, wear shoe 40, spring support 50, spring 52, spring plate 60, flange 64, rod 66, nut 68, first jack 70 and second jack 72.

The invention further comprises a method for an endgate with angle adjustment that is adapted to be attached to a screed assembly. The preferred method includes providing an endgate comprising a mounting bracket that is adapted to be attached to the screed assembly. The preferred endgate with angle adjustment also includes a pivoting plate that is pivotally attached to the mounting bracket, a sliding plate that is adapted to be pivotally moved with the pivoting plate, and a pavement contacting surface that is adapted to be pivotally moved with the pivoting plate. The preferred endgate further includes a support that is adapted to be pivotally moved with the pivoting plate, a means for applying force to the pavement contacting surface which is disposed between the support and the sliding plate, a first adjustment means that is adapted to adjust the amount of force applied by the means for applying force to the pavement contacting surface, and a second adjustment means that is adapted to adjust the angle of the pavement contacting surface. The preferred method also includes adjusting the angle of the pavement contacting surface and adjusting the amount of force applied to the means for applying force to the pavement contacting surface.

In the preferred embodiments of the method of the invention, the pivoting plate, the support, the means for applying force to the pavement contacting surface and the pavement contacting surface remain in a substantially fixed disposition relative to each other when the pavement contacting surface is pivotally moved. Also in the preferred embodiments of the method, the means for applying force to the pavement contacting surface is maintained in a substantially perpendicular disposition relative to the pavement contacting surface when the pavement contacting surface is pivotally moved. Further, in the preferred embodiments of the method, the sliding plate is adapted to be slidingly moved relative to the pivoting plate in a direction substantially perpendicular to the pavement contacting surface.

In operation, several advantages of the preferred embodiments of the apparatus and method of the invention are achieved. For example, the preferred embodiments of the invention claimed herein provide an endgate with angle adjustment that results in easier, less time-consuming adjustments. The preferred embodiments of the invention also provide an endgate with angle adjustment in which each of the means for applying force to the pavement contacting surface applies an equal load to the pavement contacting surface. The preferred embodiments of the invention further provide an endgate with angle adjustment that maintains each of the means for applying force to the pavement contacting surface associated with the endgate substantially perpendicular to the pavement contacting surface when the pavement contacting surface is pivotally moved. The preferred embodiments of the invention still further provide an endgate with angle adjustment that maintains optimal surface contact with the hot mix asphalt applied by the screed assembly and maintains uniform pressure on the hot mix asphalt.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An endgate adapted to be attached to a screed assembly and provide an outer, substantially vertical, finished edge to asphalt applied by the screed assembly, said endgate comprising:

(a) a mounting bracket, said mounting bracket being adapted to be attached to the screed assembly;

(b) a pivoting plate, said pivoting plate being pivotally attached to the mounting bracket and said pivoting plate being adapted to provide the outer, substantially vertical, finished edge to the asphalt applied by the screed assembly;

(c) a sliding plate, said sliding plate being adapted to be pivotally moved with the pivoting plate;

(d) a pavement contacting surface, said pavement contacting surface being adapted to be pivotally moved with the pivoting plate;

(e) a support, said support being adapted to be pivotally moved with the pivoting plate;

(f) a means for applying force to the pavement contacting surface, said means for applying force to the pavement contacting surface being disposed between the support and the sliding plate;

(g) a first adjustment means, said first adjustment means being adapted to adjust the amount of force applied by the means for applying force to the pavement contacting surface; and (h) a second adjustment means, said second adjustment means being adapted to adjust the angle of the pavement contacting surface.

2. The endgate of claim 1 wherein the pivoting plate, the support, the means for applying force to the pavement contacting surface and the pavement contacting surface remain in a substantially fixed disposition relative to each other when the pavement contacting surface is pivotally moved.

3. The endgate of claim 1 wherein the first adjustment means includes a first adjustment means first end that is mounted to the sliding plate and a first adjustment means second end that is mounted to the pivoting plate.

4. The endgate of claim 1 wherein the second adjustment means includes a second adjustment means first end that is mounted to the mounting bracket and a second adjustment means second end that is mounted to the pivoting plate.

5. The endgate of claim 1 wherein the sliding plate includes a flange, said flange being adapted to bear against the means for applying force to the pavement contacting surface.

6. The endgate of claim 5 wherein the flange is adapted to be moved relative to the pivoting plate in a direction substantially perpendicular to the pavement contacting surface.

7. The endgate of claim 5 wherein the means for applying force to the pavement contacting surface comprises a plurality of springs, each of said plurality of springs being biased between the support and the flange.

8. The endgate of claim 7 wherein each of the plurality of springs is disposed around a rod.

9. The endgate of claim 7 wherein each of the plurality of springs is maintained in a substantially perpendicular disposition relative to the pavement contacting surface when the pavement contacting surface is pivotally moved.

10. The endgate of claim 7 wherein each of the plurality of springs applies a substantially equal amount of force to the pavement contacting surface.

11. The endgate of claim 1 wherein the first adjustment means and the second adjustment means are jacks.

12. An endgate adapted to be attached to a screed assembly and provide an outer, substantially vertical, finished edge to asphalt applied by the screed assembly, said endgate comprising:

(a) a mounting bracket, said mounting bracket being adapted to be attached to the screed assembly;

(b) a pivoting plate, said pivoting plate being pivotally attached to the mounting bracket;

(c) a pair of spring supports, each of said spring supports being adapted to be pivotally moved with the pivoting plate;

(d) a spring plate, said spring plate having a flange and being adapted to be pivotally moved with the pivoting plate and slidingly moved relative to the pivoting plate;

(e) a wear shoe, said wear shoe being adapted to be pivotally moved with the pivoting plate;

(f) a pair of springs, each of said pair of springs being biased between one of the pair of spring supports and the flange of the spring plate, and each of said pair of springs being disposed around a rod;

(g) a first jack, said first jack being adapted to adjust the amount of force applied to the pair of springs and having a first jack first end that is mounted to the spring plate and a first jack second end that is mounted to the pivoting plate; and (h) a second jack, said second jack being adapted to adjust the angle of the pivoting plate and having a second jack first end that is mounted to the mounting bracket and a second jack second end that is mounted to the pivoting plate.

13. The endgate of claim 12 wherein the pair of springs are maintained in a substantially perpendicular disposition relative to the wear shoe when the pivoting plate is pivotally moved.

14. The endgate of claim 12 wherein each of the plurality of springs applies a substantially equal amount of force to the pavement contacting surface.

15. The endgate of claim 12 wherein the pivoting plate, the spring supports, the spring plate, the pair of springs and the wear shoe remain in a fixed disposition relative to each other when the pivoting plate is pivotally moved.

16. The endgate of claim 12 wherein the spring plate is adapted to be slidingly moved relative to the pivoting plate in a direction substantially perpendicular to the wear shoe.

17. A method for an endgate with angle adjustment that is adapted to be attached to a screed assembly, said method comprising:

(a) providing an endgate comprising:

(1) a mounting bracket, said mounting bracket being adapted to be attached to the screed assembly;

(2) a pivoting plate, said pivoting plate being pivotally attached to the mounting bracket and said pivoting plate being adapted to provide an outer, substantially vertical, finished edge to asphalt applied by the screed assembly;

(3) a sliding plate, said sliding plate being adapted to be pivotally moved with the pivoting plate;

(4) a pavement contacting surface, said pavement contacting surface being adapted to be pivotally moved with the pivoting plate;

(5) a support, said support being adapted to be pivotally moved with the pivoting plate;

(6) a means for applying force to the pavement contacting surface, said means for applying force to the pavement contacting surface being disposed between the support and the sliding plate;

(7) a first adjustment means, said first adjustment means being adapted to adjust the amount of force applied by the means for applying force to the pavement contacting surface; and (8) a second adjustment means, said second adjustment means being adapted to adjust the angle of the pavement contacting surface;

(b) adjusting the angle of the pavement contacting surface;

(c) adjusting the amount of force applied by the means for applying force to the pavement contacting surface;

(d) applying asphalt to a surface with the screed assembly; and (e) providing the outer, substantially vertical, finished edge to the asphalt applied by the screed assembly.

18. The method of claim 17 wherein the pivoting plate, the support, the means for applying force to the pavement contacting surface and the pavement contacting surface remain in a substantially fixed disposition relative to each other when the pavement contacting surface is pivotally moved.

19. The method of claim 17 wherein the means for applying force to the pavement contacting surface is maintained in a substantially perpendicular disposition relative to the pavement contacting surface when the pavement contacting surface is pivotally moved.

20. The method of claim 17 wherein the sliding plate is adapted to be slidingly moved relative to the pivoting plate in a direction substantially perpendicular to the pavement contacting surface.

* * * * *